US010033129B2

(12) United States Patent
Matsui et al.

(10) Patent No.: US 10,033,129 B2
(45) Date of Patent: Jul. 24, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Masaaki Tabata, Mie (JP); Yasuo Omori, Mie (JP)

(73) Assignees: AUTONETWORKS TECHNOLOGIES, LTD., Yokkaichi, Mie (JP); SUMIOTOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/503,414

(22) PCT Filed: Aug. 24, 2015

(86) PCT No.: PCT/JP2015/073722
§ 371 (c)(1),
(2) Date: Feb. 13, 2017

(87) PCT Pub. No.: WO2016/035596
PCT Pub. Date: Mar. 10, 2016

(65) Prior Publication Data

US 2017/0237196 A1 Aug. 17, 2017

(30) Foreign Application Priority Data

Sep. 5, 2014 (JP) ..... 2014-180763

(51) Int. Cl.
*H01R 13/506* (2006.01)
*H01R 13/514* (2006.01)
(Continued)

(52) U.S. Cl.
CPC ..... *H01R 13/514* (2013.01); *H01R 4/021* (2013.01); *H01R 13/506* (2013.01); *H01R 31/08* (2013.01)

(58) Field of Classification Search
CPC ..... H01R 13/506; H01R 13/514; H01R 4/021
(Continued)

(56) References Cited

U.S. PATENT DOCUMENTS 4,181,384 A * 1/1980 Dola ..... H01R 23/662 29/844
4,707,043 A * 11/1987 Reed ..... G01V 1/201 439/135
(Continued)

FOREIGN PATENT DOCUMENTS

JP 8-22866 1/1996
JP 11-5176 1/1999
(Continued)

OTHER PUBLICATIONS

International Search Report dated Oct. 6, 2015.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

It is aimed to make connectors accommodating wires conductive to each other without using terminals. Connectors each including wires (2) formed with core exposed portions (2B) by removing parts of coatings (2A) and a connector housing (1) for accommodating the wires (2) while exposing the core exposed portions (2B) in an opening (4) are stacked
(Continued)

with the openings (4) facing each other. An operation hole (5) is formed on a side opposite to the opening (4) in the both connector housings (1). Electrodes (9) of a welding machine are inserted through the both operation holes (5) and the core exposed portions (2B) corresponding in a stacking direction are welded to each other. In this way, the wires (2) can be directly connected between the both connectors without using terminals.

9 Claims, 22 Drawing Sheets

(51) Int. Cl.
*H01R 31/08* (2006.01)
*H01R 4/02* (2006.01)

(58) Field of Classification Search
USPC ..... 439/638, 701, 709, 796; 174/94 R
See application file for complete search history.

(56) References Cited

U.S. PATENT DOCUMENTS 4,830,625 A * 5/1989 Vignoli ..... H01R 4/2462 439/404
5,122,077 A * 6/1992 Maejima ..... H01R 13/514 439/398
5,288,250 A * 2/1994 Sumida ..... H01R 13/514 439/701
5,288,251 A * 2/1994 Sumida ..... H01R 13/514 439/701
5,320,555 A * 6/1994 Okabe ..... H01R 13/6272 439/354
5,385,490 A * 1/1995 Demeter ..... H01R 9/038 439/289
5,554,038 A * 9/1996 Morlion ..... H01R 13/514 439/108
5,977,508 A 11/1999 Takano
6,096,257 A * 8/2000 Okabe ..... H01R 13/432 264/318
6,361,355 B1 * 3/2002 Matsuoka ..... H01R 9/2408 439/488
6,461,201 B1 * 10/2002 Maeda ..... H01R 13/514 439/680
6,551,119 B1 * 4/2003 Sakamoto ..... H01R 13/514 439/287
6,652,296 B2 * 11/2003 Kuroda ..... H01R 4/185 439/607.28
6,823,587 B2 * 11/2004 Reed ..... H01R 9/05 29/854
6,857,899 B2 * 2/2005 Reed ..... H01R 23/662 439/497
7,494,367 B2 * 2/2009 Adachi ..... B23K 20/10 439/499
8,382,512 B2 * 2/2013 Morita ..... H01R 12/592 439/499
2002/0016104 A1 2/2002 Maegawa
2002/0076990 A1 * 6/2002 Fujita ..... H01R 13/514 439/701
2006/0228932 A1 * 10/2006 Komiyama ..... H01R 13/514 439/467
2009/0042445 A1 * 2/2009 Ichio ..... H01R 13/4361 439/626
2009/0081901 A1 3/2009 Nakazawa et al.

FOREIGN PATENT DOCUMENTS

JP 2001-231129 8/2001
JP 2002-42924 2/2002
JP 2002-233032 8/2002
JP 2009-76368 4/2009

* cited by examiner

CONNECTOR

BACKGROUND

1. Field of the Invention

The present invention relates to a connector.

2. Description of the Related Art

Japanese Unexamined Patent Publication No. 8-22866 discloses a connector assembly that includes male and female connectors. Male terminal fittings mounted on the tips of wires are accommodated in the male connector and female terminal fittings mounted on the tips of wires are accommodated in the female connector. The male and female connectors are connected so that paired wires are connected electrically by connecting male and female terminal fittings.

As described above, connectors connected to wires generally have been connected electrically via male and female terminal fittings. However, the terminal fittings present a problem of increasing the number of components and also increasing cost. Further, if the terminal fittings should be deformed or the like, a conduction failure is also a concern.

The present invention was completed based on the above situation and aims to enable connectors connected to wires to be connected to each other without using terminal fittings.

SUMMARY

The invention is directed to a connector with wires, each of which is formed with a core exposed portion by removing a part of a coating. A first connector housing is formed with a cavity for accommodating the wire and an opening for exposing the core exposed portion to outside with the wire accommodated in the cavity. A second connector housing is stackable to the first connector housing and is formed with a cavity for accommodating the wire. The second connector housing is configured to expose the core exposed portion with the wire accommodated in the cavity, and is formed with an opening communicating with the opening of the first connector housing while facing the opening of the first connector housing when the first and second connector housings are stacked. The core exposed portions corresponding in a stacking direction are connected directly when the first and second connector housings are stacked.

According to the present invention, the wires accommodated in the first and second connector housings in a stacked state and corresponding in the stacking direction can be connected directly through the openings of the connector housings. Specifically, unlike before, the corresponding wires are connected directly without using terminal fittings. Thus, the number of components can be reduced more than before, there is no concern for a conduction error due to the deformation of the terminal fittings and reliable conduction is possible.

An operation hole may be open on an outer surface of the first connector housing opposite to the opening formed in the first connector housing in the stacking direction for exposing the core exposed portion of the wire accommodated in the first connector housing to outside. Similarly, an operation hole may be open on an outer surface of the second connector housing opposite to the opening formed in the second connector housing in the stacking direction for exposing the core exposed portion of the wire accommodated in the second connector housing to outside. According to this configuration, operating portions of a machine for welding can be introduced through the operation holes formed in the first and second connector housings. Thus, the corresponding core exposed portions can be welded to each other easily and smoothly. Welding may include connection by soldering beside connection by various types of welding such as resistance welding.

Each of the first and second connector housings may be provided with a cover for opening and closing the operation hole formed therein. The covers prevent tiny foreign matters may from entering the operation holes.

The first and second connector housings may be provided with at least one of a lock and a lock receiving portion for locking a stacked state. The lock and the lock receiving portion may be lockable together in a stacked state when the connector housings are stacked so that the wires pulled out to outside from the connector housings extend in the same direction and also in a stacked state where the wires pulled out to outside from the respective connector housings extend in opposite directions. According to this configuration, desired wire arrangement directions can be selected.

The connector may include a substantially tubular casing for accommodating the first and second connector housings in a stacked state, the casing may be formed with two windows for exposing the respective operation holes of the connector housings in the stacked state. The connector housings in the stacked state may be slidable between an operation position where the operation holes are aligned with the windows of the casing and a storage position where the windows are closed by outer surfaces of the connector housings with the operation holes and the windows not aligned. According to this configuration, the operating portions of the machine for welding can be inserted into the connector housings through the operation holes and the corresponding core exposed portions can be welded easily and smoothly to each other. If the connector housings are moved from the operation position to the storage position after welding is completed, the windows of the casing are closed by the outer surfaces of the connector housings so that foreign matter cannot enter the connector housings can be prevented.

Wires may be accommodated in parallel in the first and second connector housings, and at least one of the connector housings may include the core exposed portion of the wire intersecting with the other core exposed portions and connected at each intersecting portion. According to this configuration, desired wires can be jointed in the connector housing.

DETAILED DESCRIPTION

FIGS. 1 to 10 show a first embodiment of the invention. Since the invention may employ connector housings different in structure in the case of connecting wires, the connector housings are distinguished to be a first connector housing and a second connector housing in the description of the present invention. However, in the first embodiment, wires are connected using connectors entirely identical in structure including connector housings. Thus, in the following description, the connector housings are described without being particularly distinguished, and are called an upper connector housing and a lower connector housing according to graphical representation when being distinguished.

A connector housing 1 is made of synthetic resin and wires 2 are accommodated in parallel in a width direction. The connector housing 1 is formed with cavities 3A, 3B arranged in parallel in the width direction for accommodating the respective wires 2 while partitioning them. The cavities 3A, 3B are formed across an opening 4 and an operation hole 5 in a front-back direction. The front cavities 3A are formed on a front side, the rear cavities 3B are formed on a rear side and the cavities corresponding in the front-back direction are located on the same axes.

Figure 3:
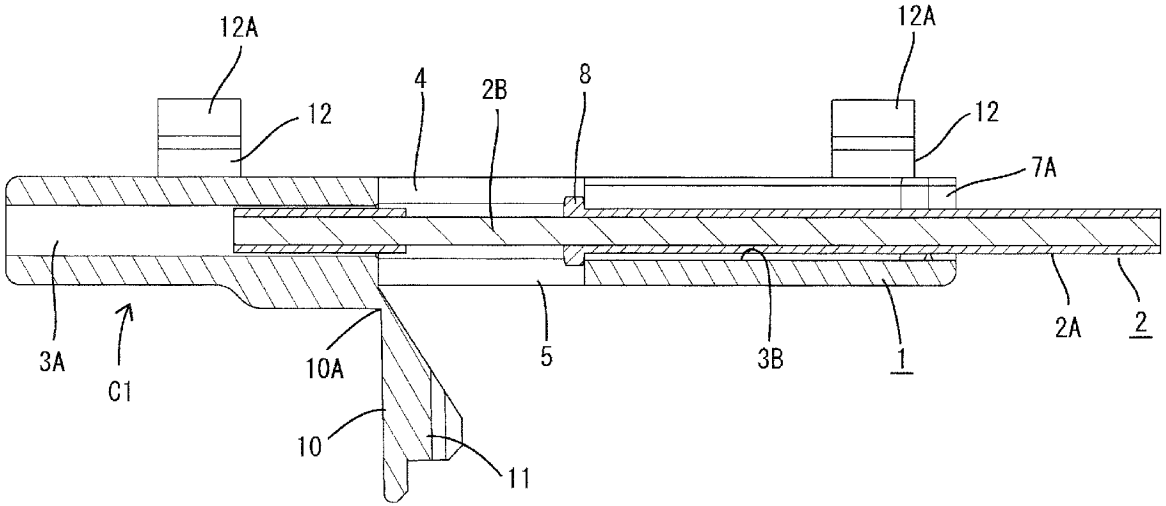
FIG. 3 is a section along A-A of FIG. 2.

Each front cavity 3A has a hollow cylindrical shape extending along an axial direction of the wire 2 and opposite axial ends are open. As shown in FIG. 3, the wire 2 has a coating 2A removed over a predetermined length range in a part near the tip thereof, thereby forming a core exposed portion 2B. A part of the wire 2 closer to the tip than the core exposed portion 2B is press-fit and inserted into the front cavity 3A, and a side of the wire 2 behind the core exposed portion 2B is accommodated into the rear cavity 3B.

Figure 1:
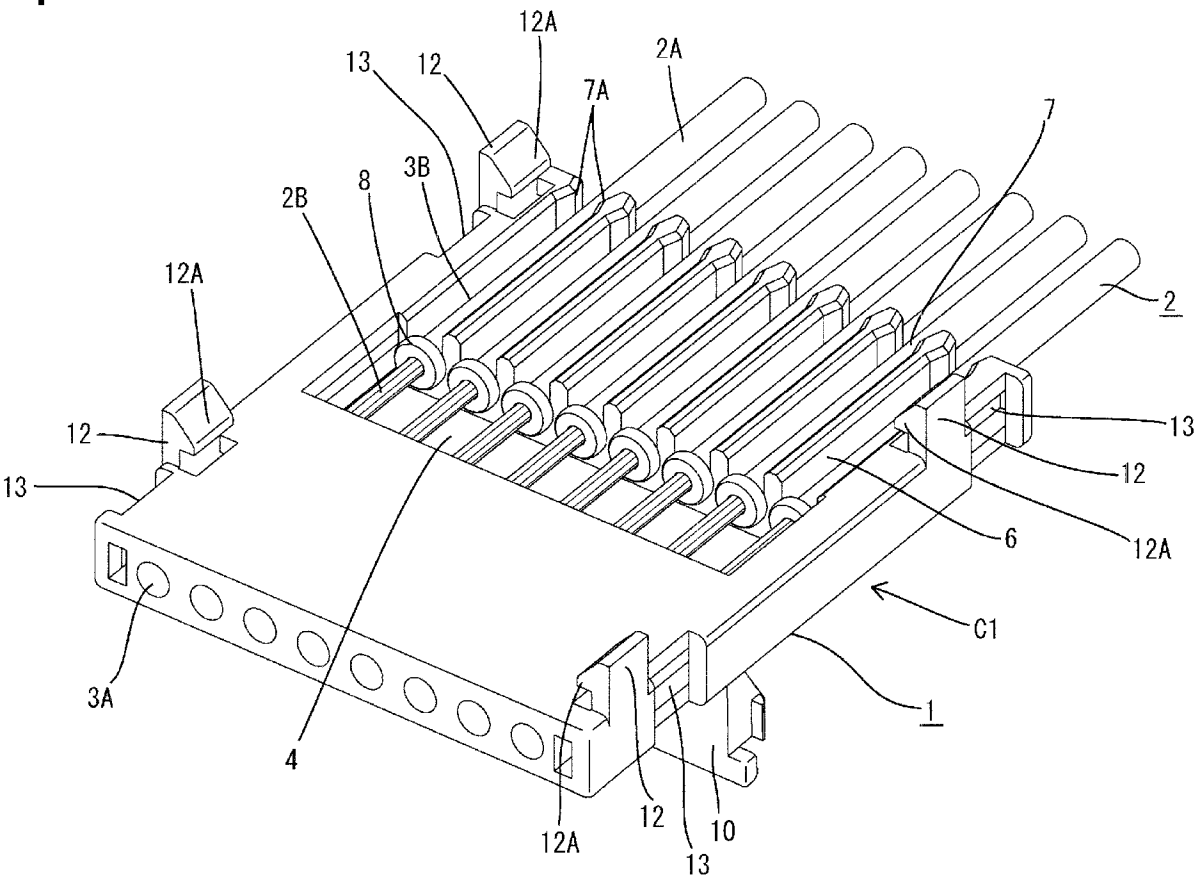
FIG. 1 is a perspective view showing a connector in a first embodiment.

As shown in FIG. 1, surfaces facing each other in the case of vertically stacking the connector housings 1 are entirely open in areas behind the openings 4, to be described later, to expose the rear cavities 3B. In this way, the laterally adjacent rear cavities 3B are partitioned by partition walls 6 extending along the front-back direction. Each rear cavity 3B is open in the front-back direction and a facing direction in the case of stacking the connector housings 1. Thus, the wires 2 can be press-fit and inserted from a shown upper side while extending along an extending direction of the rear cavities 3B.

Figure 4:
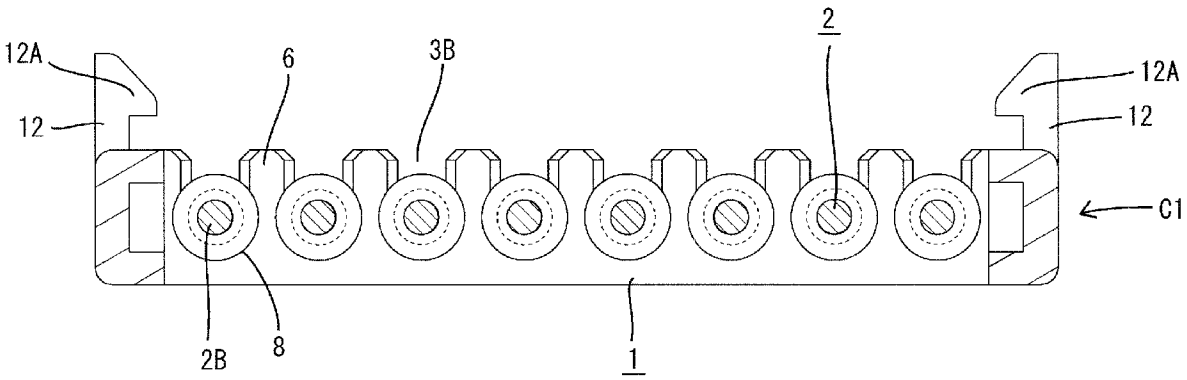
FIG. 4 is a section along B-B of FIG. 2.
Figure 5:
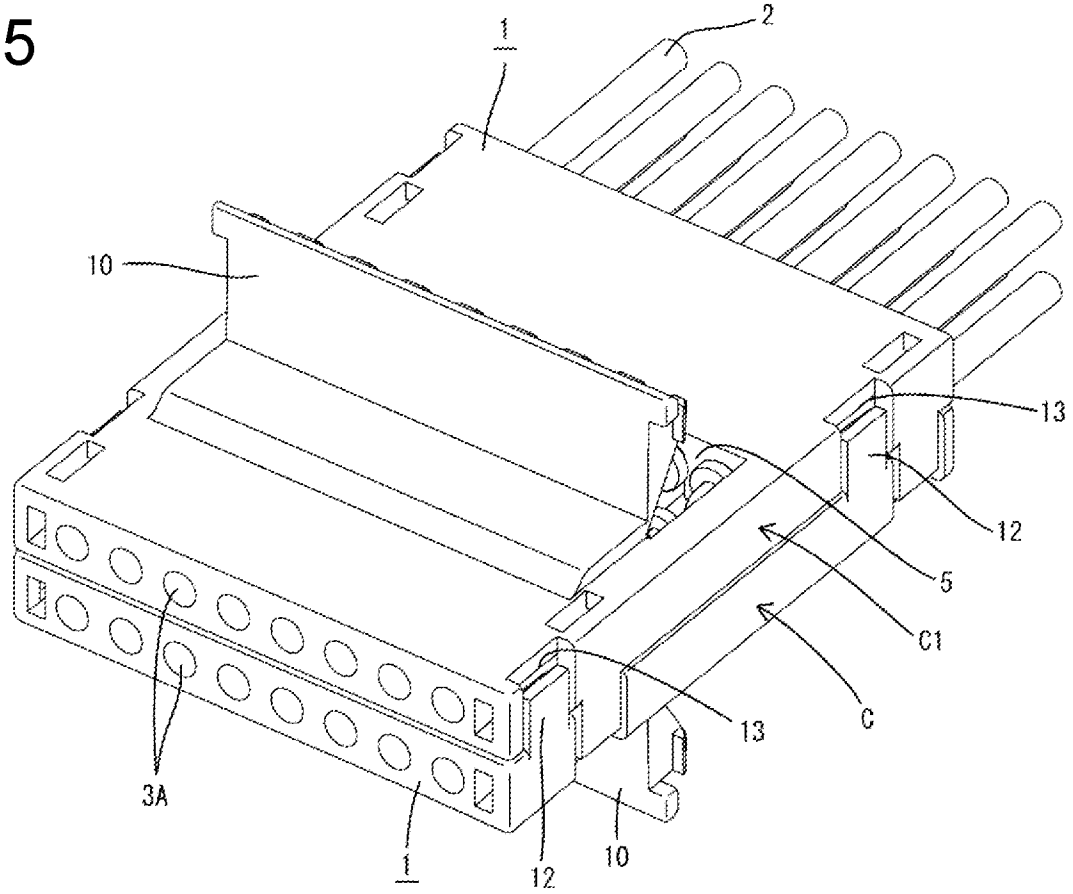
FIG. 5 is a perspective view showing a state where connectors are stacked.

As shown in FIG. 4, a height of each partition wall 6 is larger than an outer diameter of the entire wire 2. Further, as shown in FIG. 1, protrusions 7A projecting in directions toward each other are formed on side surfaces of rear end parts of the respective partition walls 6, thereby narrowing an interval between the partition walls 6 to form throats 7. Each wire 2 has the coating 2A strongly sandwiched by this throat 7 and is unlikely to be detached in a direction opposite to an inserting direction.

Further, in the case of the first embodiment, an end part of the coating 2A behind the core exposed portion 2B is creased in removing the coating 2A, thereby forming a crease 8 with a larger diameter than a general part of the coating 2A. With each wire 2 accommodated in the cavities 3A, 3B, the crease 8 is stopped in contact with the front end surfaces of the partition walls 6 sandwiching the wire 2. By doing so, each wire 2 can be accommodated in the corresponding cavities 3A, 3B in a state positioned with respect to the front-back direction and the crease 8 functions to suppress detachment in a pull-out direction when the wire 2 is pulled out backward.

The opening 4 in the connector housing 1 is provided in a substantially central part in the front-back direction (part between the front and rear cavities 3A, 3B) of the surface facing the mating connector housing 1 in the case of vertically stacking the connector housings 1 to expose the entire core exposed portions 2B of the wires 2 accommodated in the connector housing 1 to outside.

Figure 2:
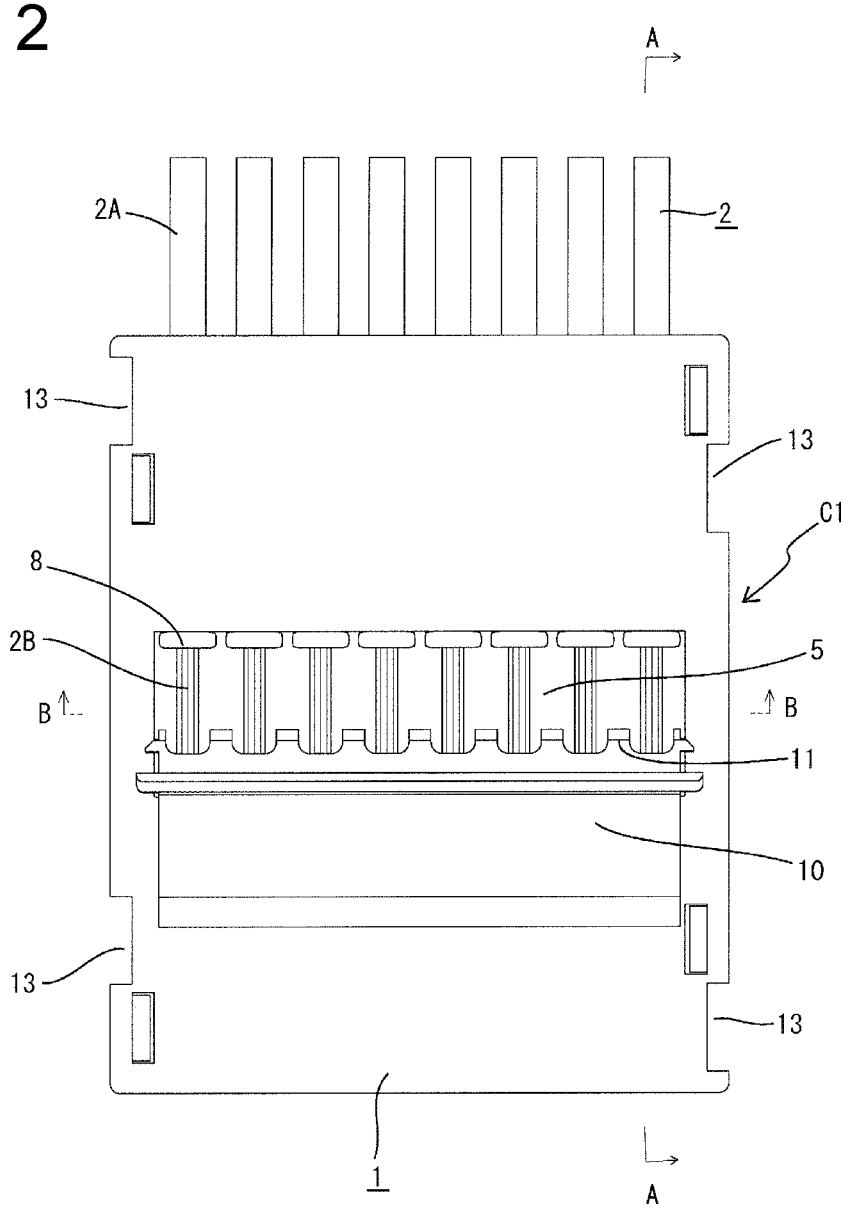
FIG. 2 is a bottom view of the connector.
Figure 6:
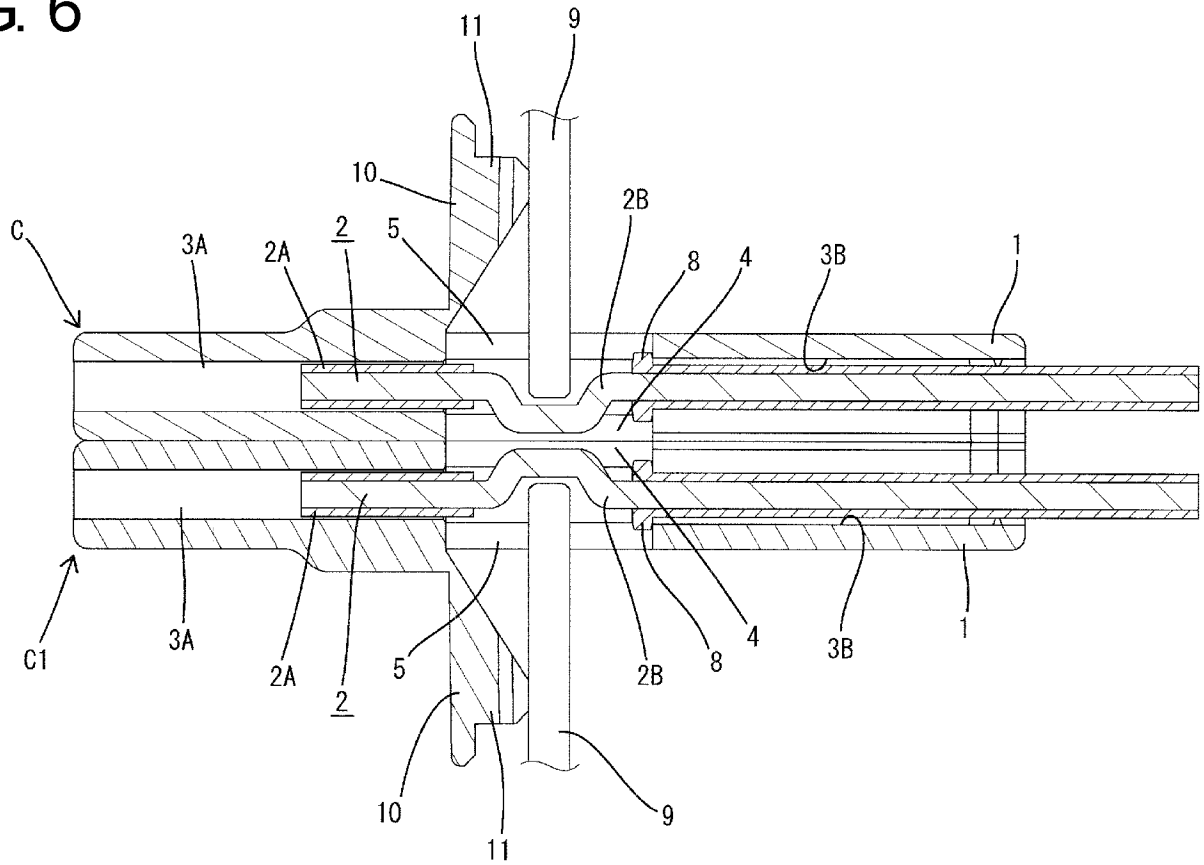
FIG. 6 is a side view in section showing a state of operation of welding core exposed portions.

As shown in FIG. 2, the operation hole 5 in the connector housing 1 is open in a part corresponding to the opening 4 in the stacking direction on the surface opposite to the one provided with the opening 4 (surface on a lower or upper side when the two connector housings 1 are stacked vertically). As shown in FIG. 6, the operation hole 5 is for allowing the entrance of electrodes 9 (operating portions) for resistance welding. The operation hole 5 has substantially the same opening range as the opening 4 and is provided at a position aligned with the opening 4.

Figure 7:
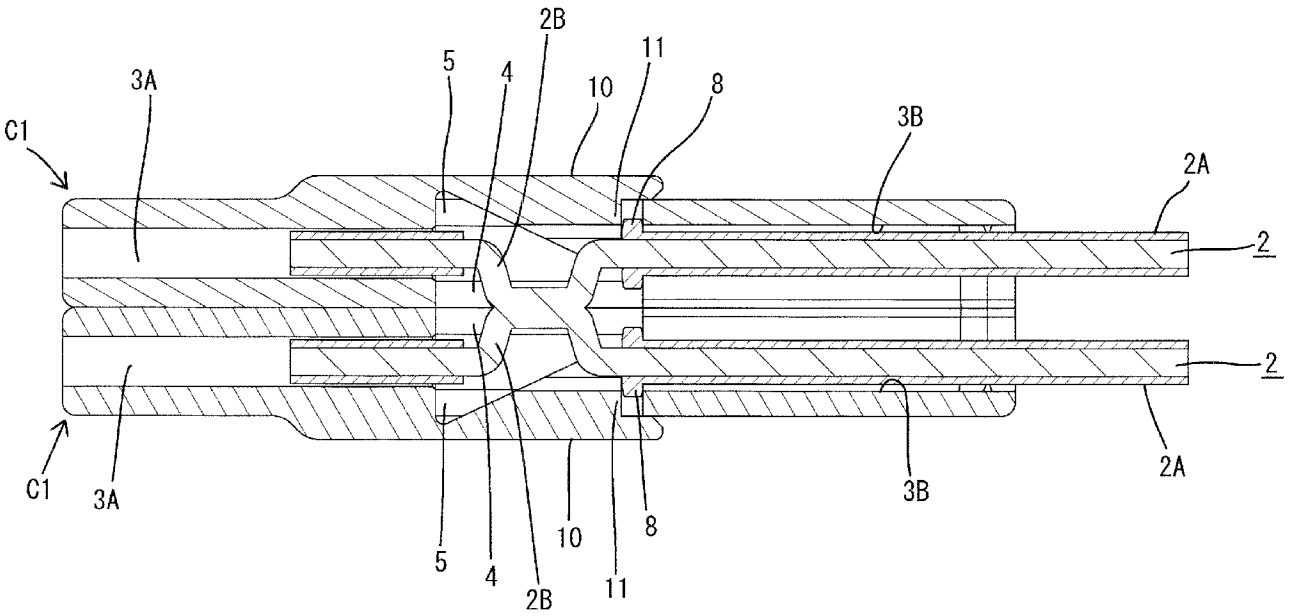
FIG. 7 is a side view in section showing a state where a welding operation is completed and covers is closed.
Figure 8:
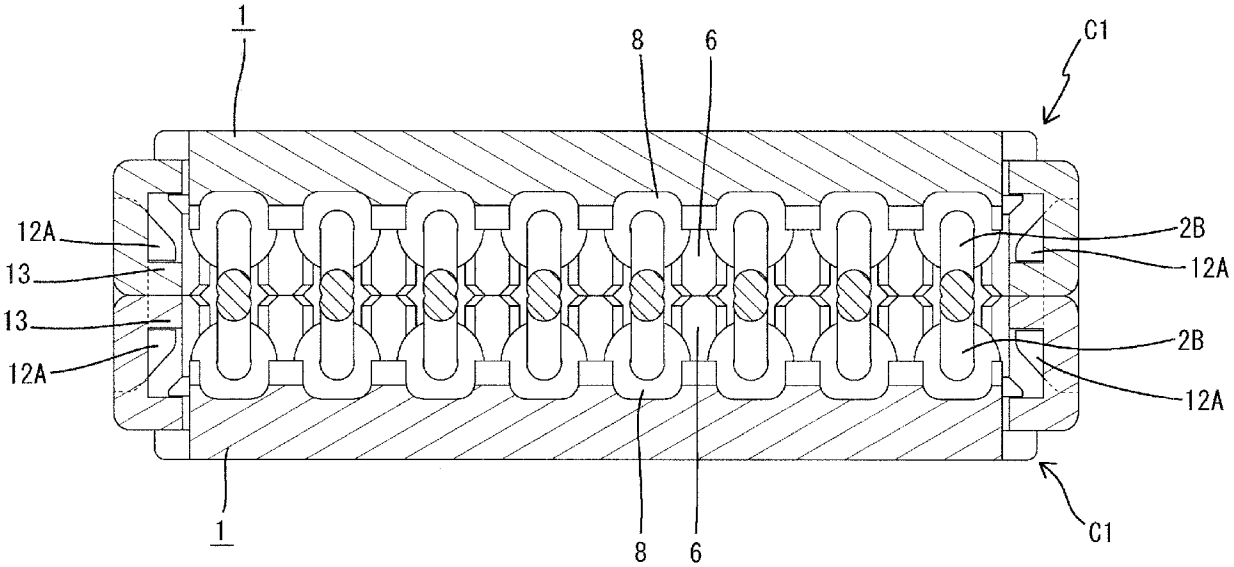
FIG. 8 is a front view in section showing the state of FIG. 7.

The connector housing 1 is provided with a cover 10 for opening and closing the operation hole 5. The cover 10 is connected via a thin hinge edge 10A provided along a side of the opening edge of the operation hole 5 on the side of the front cavities 3A. When the connector housings 1 are stacked and the core exposed portions 2B corresponding in the stacking direction are welded, the covers 10 are at an open position as shown in FIG. 6 so as not to interfere with the electrodes 9. On the other hand, after the welding operation is completed, the covers 10 are displaced to a closed position as shown in FIG. 7 to close the entire operation holes 5 substantially without leaving any clearance. Note that an unillustrated locking edge is formed on a tip part of the cover 10 and releasably locked to the opening edge of the operation hole 5 to hold the cover 10 at the closed position.

The cover 10 also is provided with a retainer function for the wires 2. That is, locking protrusions 11 are formed on a tip part of an inner surface of the cover 10 and can effectively resist against a pulling force acting on the wire 2 by compressing the creases 8 when the cover 10 is at the closed position.

As shown in FIG. 1, front and rear lock pieces 12 are arranged on each of opposite widthwise side surfaces of the connector housing 1. Each lock piece 12 is formed integrally to project toward the mating connector housing 1 to be stacked to this connector housing 1, and a lock claw 12A projects inwardly on the tip edge thereof. Each lock piece 12 is resiliently deformable in inward and outward directions with respect to the width direction of the connector housing 1. Lock receiving portions 13 lockable to the lock claws 12A are arranged at positions adjacent to the respective lock pieces 12 in the front-back direction on the opposite widthwise surfaces of the connector housing 1.

As shown in FIG. 1, the lock pieces 12 and the lock receiving portions 13 are arranged to correspond with respect to the width direction of the connector housing 1. That is, the lock piece 12 is arranged on a side opposite to the position of the lock receiving portion 13 in the width direction of the connector housing 1. Thus, when upper and lower connectors C1 are stacked with the openings 4 facing each other, the lock pieces 12 and the lock receiving portions 13 are locked with the facing surfaces of the connectors C1 aligned. In this way, the connectors C1 are held in a stacked state to prevent separation and, in the locked state, the lock pieces 12 face front and rear wall surfaces in the corresponding lock receiving portions 13 substantially without leaving any clearance, thereby preventing the connectors C1 from being displaced in the front-back direction. With the connectors C1 stacked in this way, displacements with respect to the vertical, front-back and width directions are restricted.

The respective lock pieces 12 and the respective lock receiving portions 13 in the first embodiment are arranged point-symmetrically when the surface of the connector housing 1 on the side of the opening 4 is viewed from above. Thus, as described above, even if the connector housings 1 are stacked so that the wires 2 are pulled out in the same direction from the connector housings 1 (state shown in FIG. 5), the respective lock pieces 12 and the lock receiving portions 13, as locking partners of the lock pieces 12, are configured to have a corresponding relationship. In addition, even if the connector housings 1 are stacked so that the wires 2 are pulled out in opposite directions from the connector housings 1 (state shown in FIG. 9), the respective lock pieces 12 and the lock receiving portions 13 as locking partners of the lock pieces 12 are configured to have a corresponding relationship.

Next, functions of the first embodiment configured as described above are described. First, the wire 2 is set with respect to the connector housing 1. Prior to this operation, the cover 10 is set at the open position. In the operation of setting the wire 2, the tip part of each wire 2 formed with the core exposed portion 2B is press-fit and inserted into the front cavities 3A. An insertion depth at this time is set so that rear end part of the coating 2A slightly bulges out from the front cavity 3A. When the coating 2A of the wire 2 is pushed into the rear cavity 3B corresponding to the front cavity 3A in the front-back direction, the coating 2A of the wire 2 is held compressed in the width direction by the throat 7. Further, the wire 2 is formed in advance with the crease 8 on the rear end part of the core exposed portion 2B. If the crease 8 is brought into contact with the front end surfaces of the partition walls 6, the wire 2 is positioned in the front-back direction with respect to the connector housing 1 and the entire core exposed portion 2B is exposed in the opening 4 and the operation hole 5. By repeating the above operation for all the cavities, two connectors C1 having the wires 2 completely set are prepared.

Next, an electrical connecting operation of the both connectors C1 is described. In this operation, the connectors C1 are stacked with the one connector C1 as the upper connector and the other connector as the lower connector. At this time, the lower connector C1 is oriented so that the surface formed with the opening 4 is faced up and the upper connector C1 is oriented such that the surface formed with the opening 4 is faced down. Further, the two connectors C1 are stacked while being aligned so that the respective wires 2 are pulled out to the outside in the same direction from both connectors C1. In this way, the lock claws 12A of the respective lock pieces 12 on the lower connector C1 are locked to the corresponding lock receiving portions 13 on the upper connector C1. Thus, the connectors C1 are held vertically stacked. At this time, the connectors C1 are held with displacements in the vertical direction (separating direction), the front-back direction and the width direction prevented.

The connectors C1 in the stacked state are set in a resistance welding machine with the covers 10 of the connectors C1 left at the open position. Then, as shown in FIG. 6, the electrodes 9 of the resistance welding machine are inserted into the connectors C1 through the operation holes 5. Then, the core exposed portions 2B corresponding in the stacking direction are brought closer to each other and held in close contact in longitudinal central parts as the electrodes 9 are inserted. Since welding currents are applied to the electrodes 9 pressing these close-contact parts, the close-contact parts of the core exposed portions 2B are melted and welded to each other. In this way, the wires 2 accommodated in the connectors C1 and corresponding in the stacking direction are connected directly to each other.

Thereafter, the covers 10 of both connectors C1 are closed after th electrodes 9 are retracted from the connectors C1. The cover 10 of this embodiment is formed with the locking protrusions 11. Thus, the locking protrusions 11 are locked to the front surface sides of the respective creases 8 at the closed position of the cover 10. Thus, each crease 8 is held in a state where the diameter thereof is larger than the general part of the coating 2A. Therefore, a pulling force can be received even if the wire 2 is pulled and, hence, the action of the pulling force of the wire 2 on the welded part of the core exposed portions 2B itself can be avoided.

The wires of both connectors C1 corresponding in the stacking direction are connected directly to each other in the above way, without the use of terminals. Thus, the number of components can be reduced. Further, a problem of a conduction failure possibly occurring between the terminals can be avoided. Furthermore, a pulling force applied to the wire 2 is prevented from acting on the connected part of the wires 2 (welded part of the core exposed portions 2B) by providing the creases 8 and the cover 10 having a retainer function. Therefore, connection reliability can be enhanced.

The cover 10 naturally exhibits a function of closing the operation hole 5 so that dust and the like cannot enter the connector.

In the first embodiment, both connectors C1 have entirely identical configurations, including the connector housings 1. In that respect, conventional connectors require pairs of male and female terminals and a pair of male and female connector housings 1. Thus, the number of components is large and management is troublesome. However, in the first embodiment, the number of components is reduced and management is easy.

Figure 9:
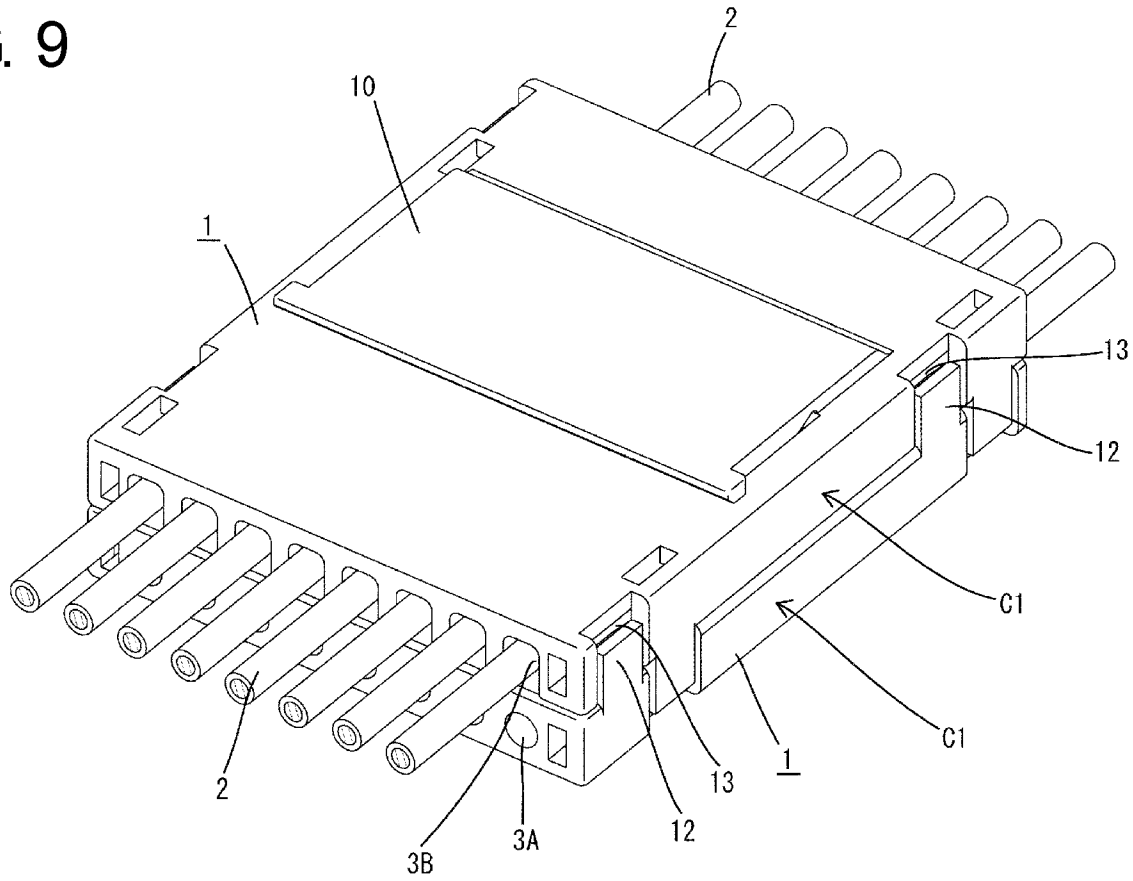
FIG. 9 is a perspective view showing a state where the welding operation is completed and the covers are closed with the connectors stacked such that the wires are pulled out in opposite directions.
Figure 10:
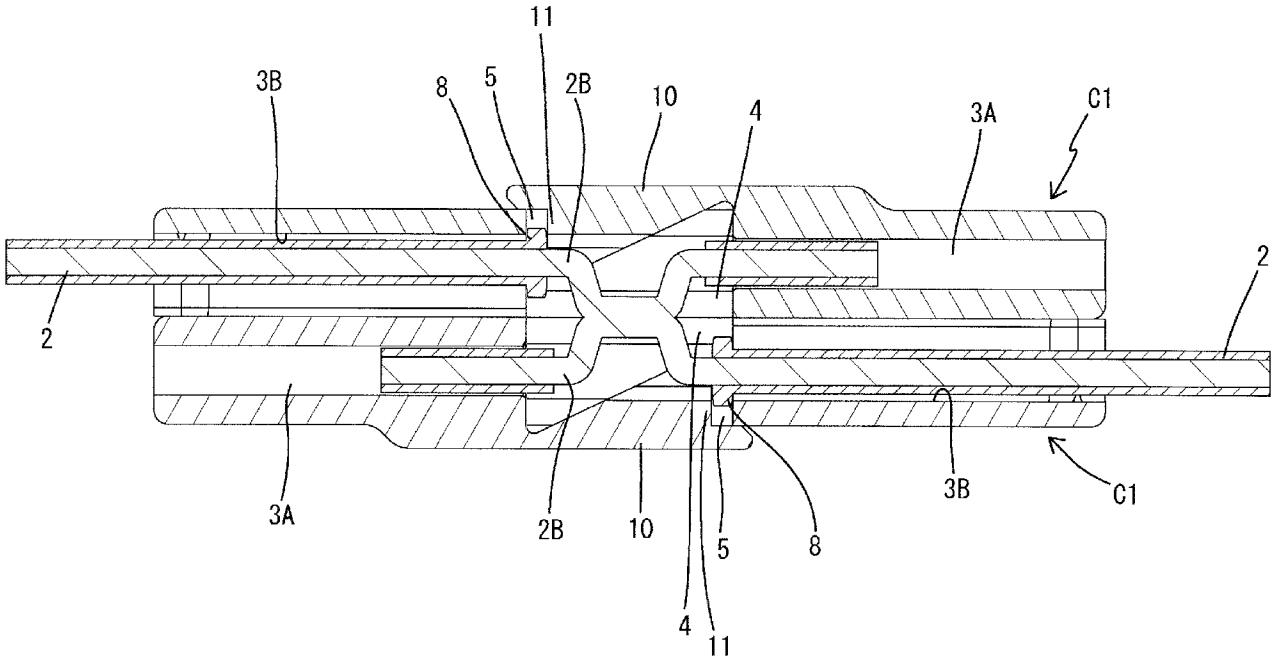
FIG. 10 is a side view in section showing the state of FIG. 9.

Furthermore, in the first embodiment, it is also possible to select such a specification that the wires 2 are pulled out in opposite directions between the connectors in the case of stacking the connectors C1, as shown in FIGS. 9 and 10. Specifically, in the first embodiment, the arrangement relationship of the lock pieces 12 and the lock receiving portions 13 is set such that the lock pieces 12 and the lock receiving portions 13 are locked even if the connectors C1 are stacked in such orientations. Thus, an effect of being able to select which of the specifications should be adopted in accordance with desired arrangement directions of the wires 2 is obtained.

Figure 11:
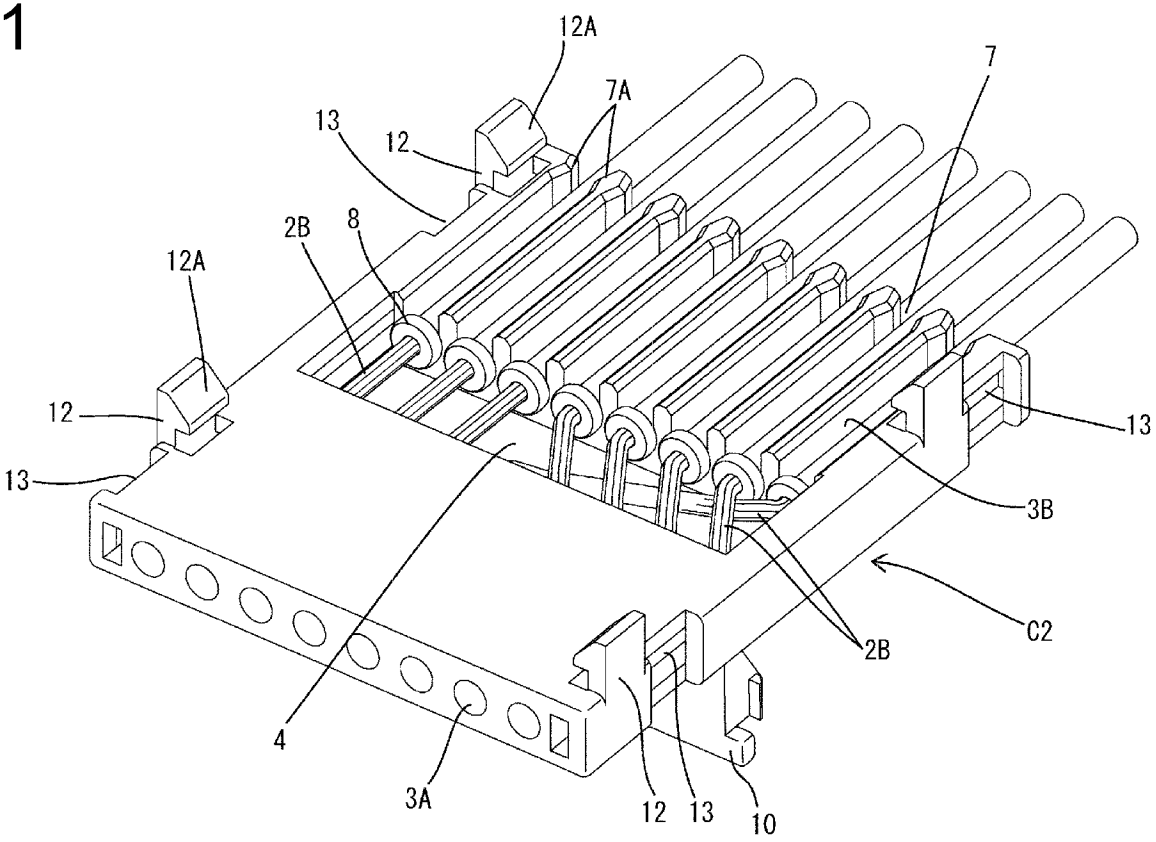
FIG. 11 is a perspective view showing a connector in a second embodiment.
Figure 12:
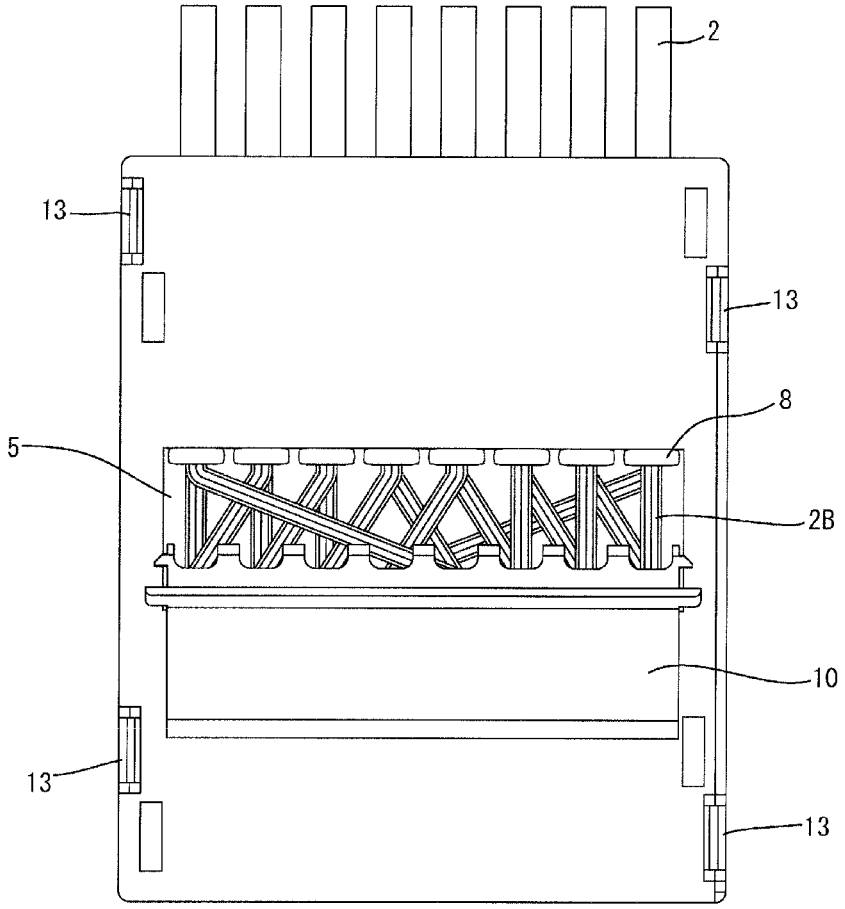
FIG. 12 is a plan view showing a stacked state of connectors viewed from an underside.

FIGS. 11 and 12 show a connector C2 according to a second embodiment of the invention. In the first embodiment, the respective wires 2 are set in the front and rear cavities 3A, 3B located on the same axes and are all accommodated in parallel in one connector housing 1. However, in the second embodiment, plural wires 2 are jointed in one connector housing 1 by accommodating wires 2 so that a plurality of core exposed portions 2B intersect.

Specifically, as shown in FIG. 11, parts of five wires 2 shown on a right side, excluding the one on a widthwise end part, closer to tips than the core exposed portions 2B are press-fit into front cavities 3A shifted to the right by one. Thus, the core exposed portions 2B of these four wires are arranged obliquely in parallel. On the other hand, the wire 2 located on the widthwise end part is formed to have a longer core exposed portion 2B than the above-mentioned four core exposed portions 2B. Further, the core exposed portion 2B of this wire 2 is oblique in a direction opposite to the oblique arrangement direction of the four core exposed portions 2B to intersect with all of the four core exposed portions 2B and, then, the tip side of this wire is press-fit into the predetermined front cavity 3A.

Note that the remaining wires 2 are set straight in the front and rear cavities 3A, 3B corresponding in the front-back direction as in the first embodiment.

In the second embodiment, the respective intersecting parts of the core exposed portions 2B may be welded before both connectors C2 are stacked. This operation is performed in a manner described above with a cover 10 held at an open position. In this way, a total of five wires 2 are jointed.

Subsequently, the connectors C2 are stacked and the core exposed portions 2B arranged straight in the lower connector C2 are welded respectively to the jointed core exposed portions 2B in the upper connector C2. Simultaneously, the core exposed portions 2B arranged straight in the upper connector C2 are welded respectively to the jointed core exposed portions 2B in the lower connector C2. By doing so, desired wires 2 can be jointed between both connectors.

The other configuration is the same as in the first embodiment and, hence, can exhibit similar functions and effects.

FIGS. 13 to 22 show a third embodiment of the invention. In the third embodiment, a connector housing 14 does not include a cover 10 for opening and closing an operation hole 5. Instead, a casing 15 for accommodating both connectors C3 in a stacked state to surround them from outside is provided and the operation holes 5 are opened and closed by this casing 15.

Figure 13:
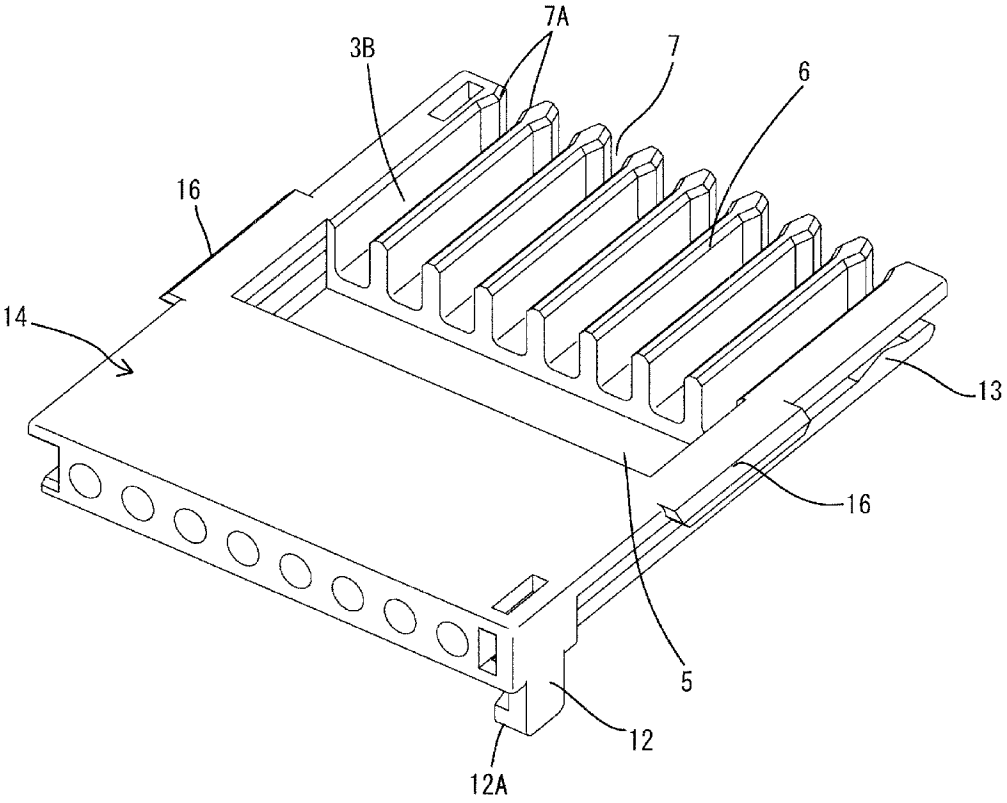
FIG. 13 is a perspective view of a connector housing in a third embodiment viewed from a top side.
Figure 14:
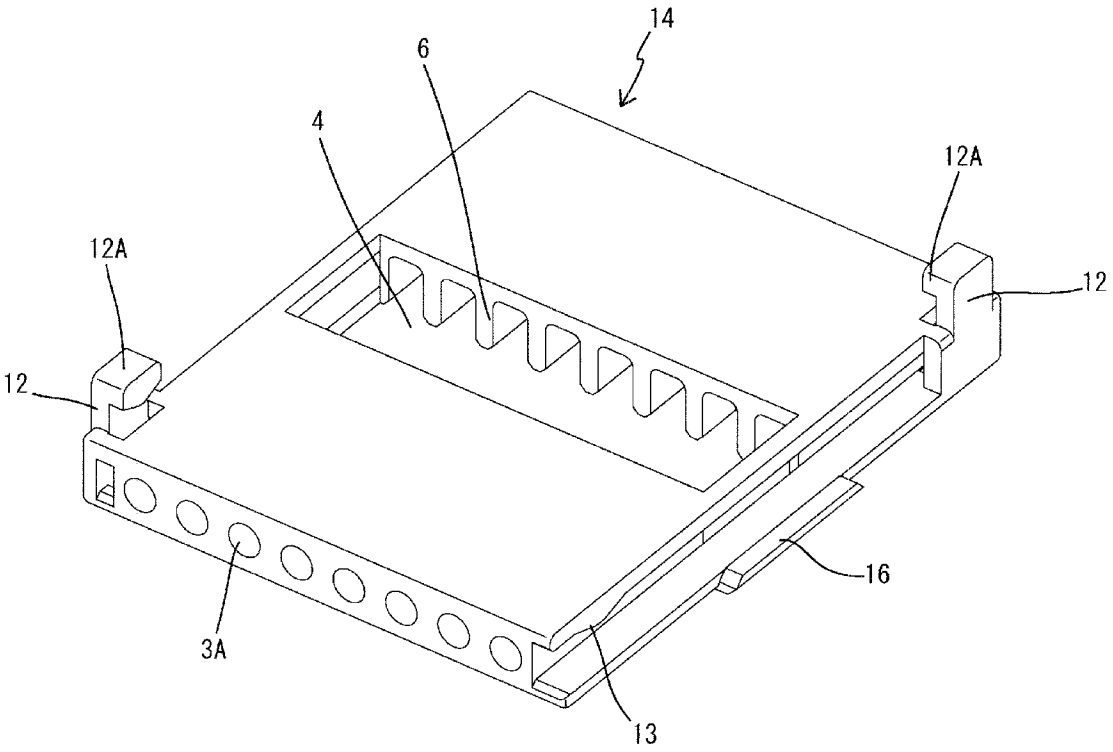
FIG. 14 is a perspective view of the connector housing viewed from an underside.
Figure 15:
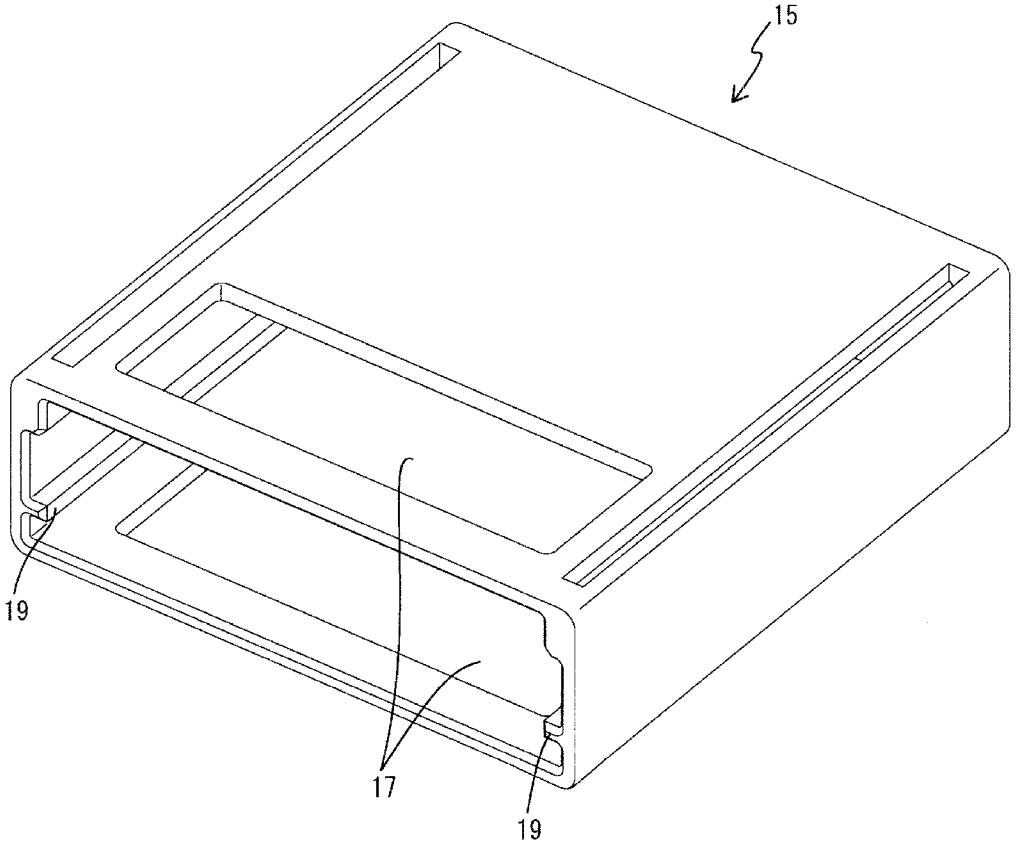
FIG. 15 is a perspective view of a casing.

FIG. 13 is a perspective view of the connector housing 14 viewed from an outer surface side when the connector housings 14 are stacked to each other. FIG. 14 is a perspective view of the connector housing 14 conversely viewed from an inner surface side (facing surface side). The connector housing 14 differs from the connector housing 1 of the first embodiment in several respects. First, the cover 10 is not formed for the operation hole 5. Second, protruding pieces 16 protruding outward in a width direction are formed in central parts in a front-back direction on opposite widthwise end edges of the surface where the operation hole 5 is open. Third, lock pieces 12 are provided only at one pair of diagonal positions of a surface of the connector housing 14 where an opening 4 is formed and lock receiving portions are provided only at the other diagonal positions. Fourth, partition walls 6 are exposed entirely on the surface where the operation hole 5 is open.

The casing 15 is made of synthetic resin similar to the connector housing 14. More particularly, the casing 15 is formed into a tubular shape into which the both connectors C3 in the stacked state can be slid and stored, and is open both forward and backward. Further, two windows 17 are open in parts of both upper and lower surfaces (surfaces facing each other in the stacking direction of the connectors) of the casing 15 near a front end part. The window s 17 have substantially the same size as the operation holes 5 and the openings 4 of the connector housings 14 and are aligned with the operation holes 5 when the connectors C3 in the stacked state are held at an operation position with respect to the casing 15 (position shown in FIGS. 17 and 18 where the connectors C3 in the stacked state partly project outward without being completely accommodated in the casing 15). However, when the connectors C3 in the stacked state are held at a storage position with respect to the casing 15 (position shown in FIGS. 20 and 21 where the connectors C3 in the stacked state are completely accommodated in the casing 15), the windows 17 are not aligned with the operation holes 5 and are closed by parts of front sides of the outer surfaces of the corresponding connector housings 14. When the connectors are held at the storage position in the casing 15, the front and rear surfaces of both connectors are substantially flush with front and rear opening edges of the casing 15.

Figure 16:
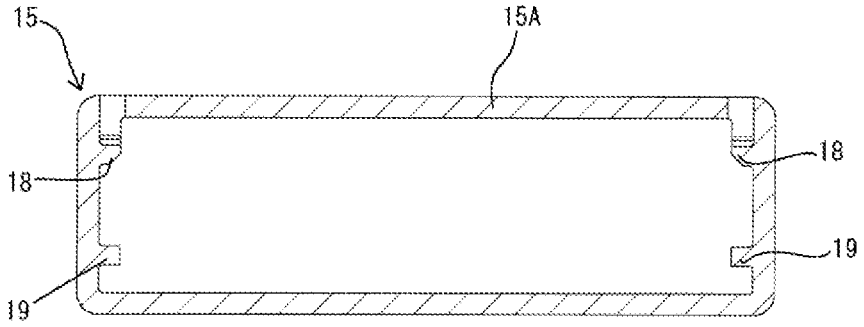
FIG. 16 is a front view in section of the casing.
Figure 17:
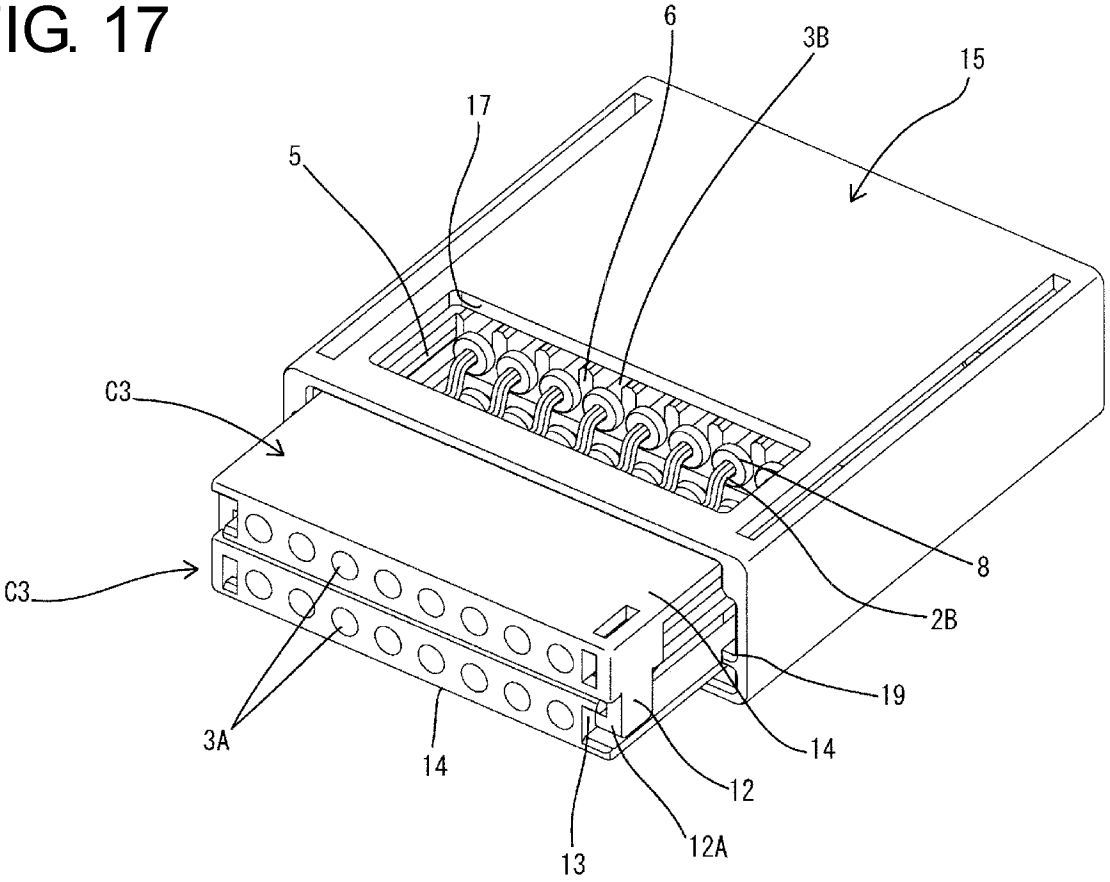
FIG. 17 is a perspective view showing a state where connectors in a stacked state are accommodated at an operation position in the casing.
Figure 18:
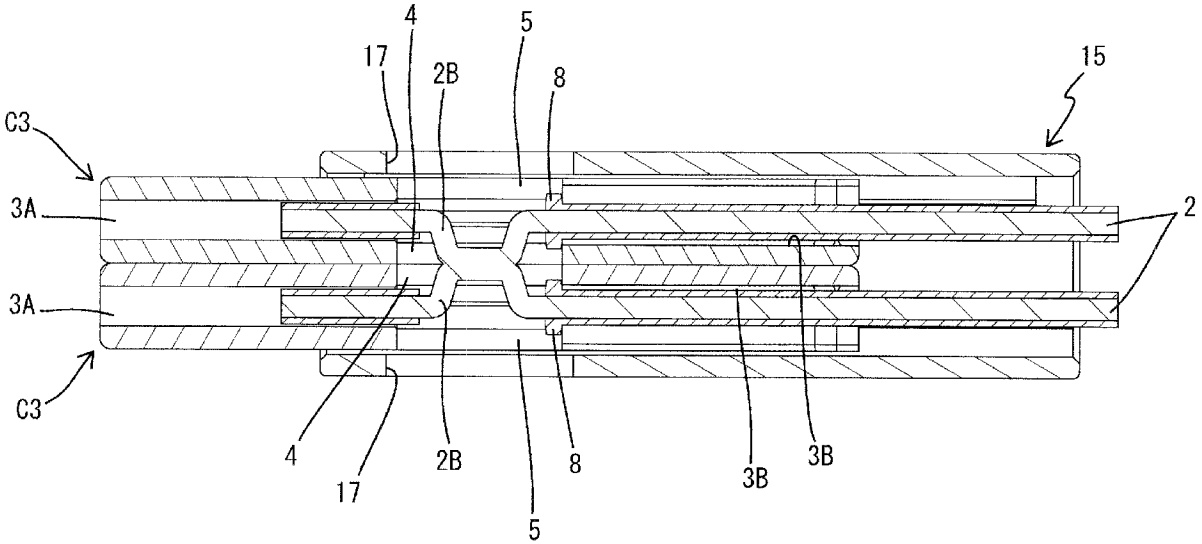
FIG. 18 is a side view in section showing the state of FIG. 17.
Figure 19:
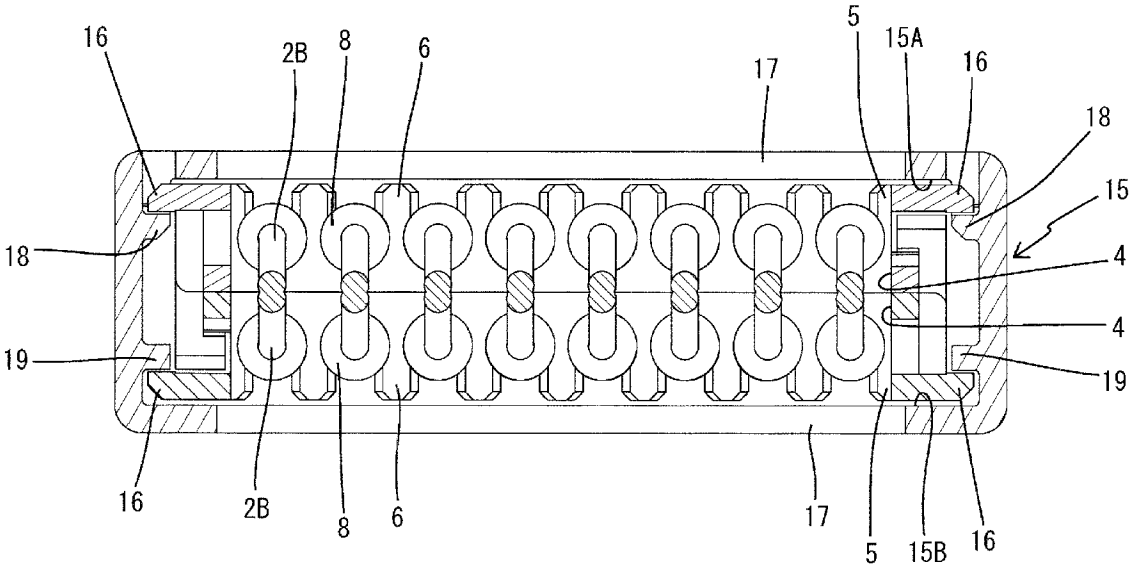
FIG. 19 is a front view in section showing the state of FIG. 17.
Figure 20:
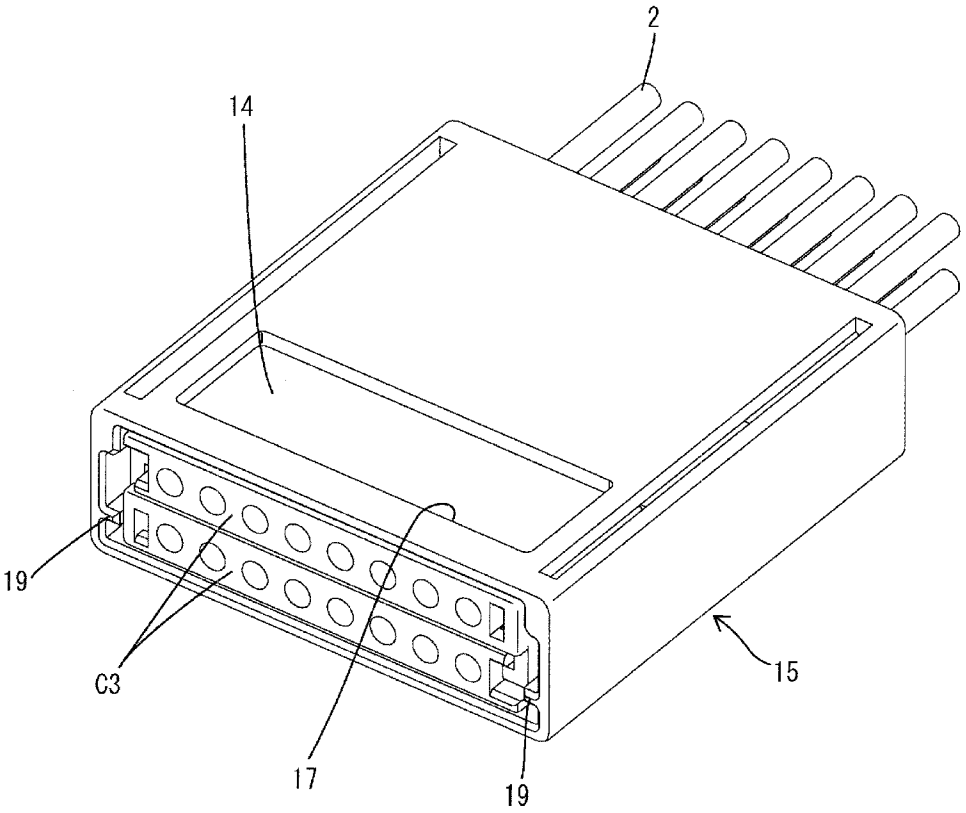
FIG. 20 is a perspective view showing a state where the connectors in the stacked state are accommodated at a storage position in the casing.
Figure 21:
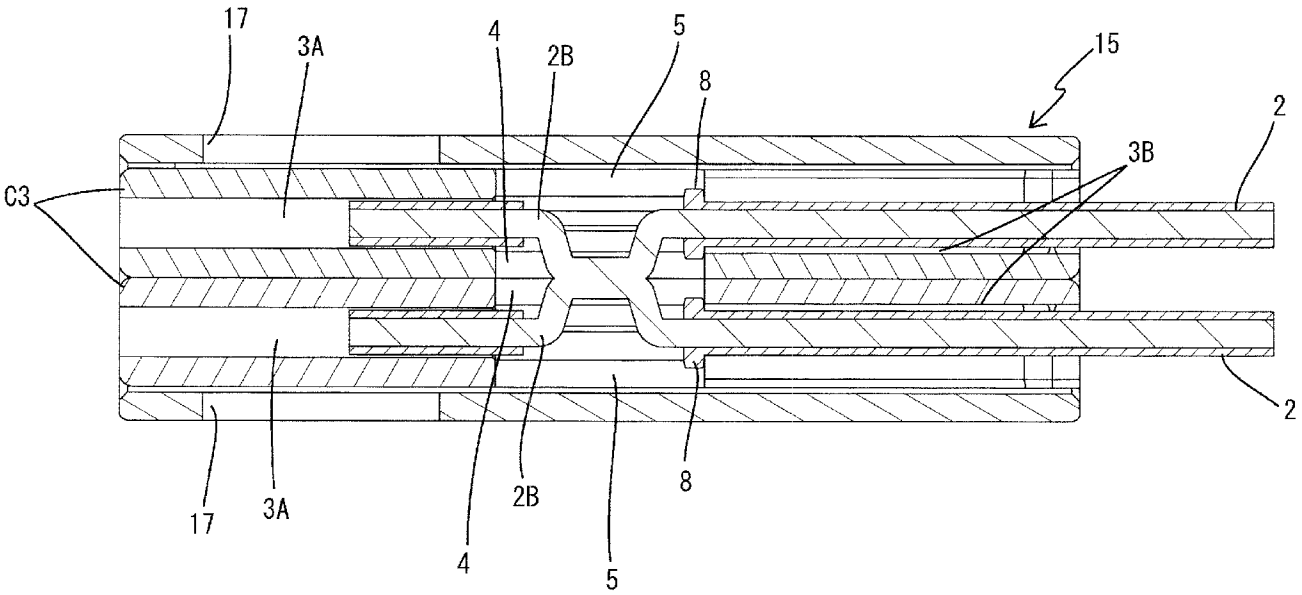
FIG. 21 is a side view in section showing the state of FIG. 20.
Figure 22:
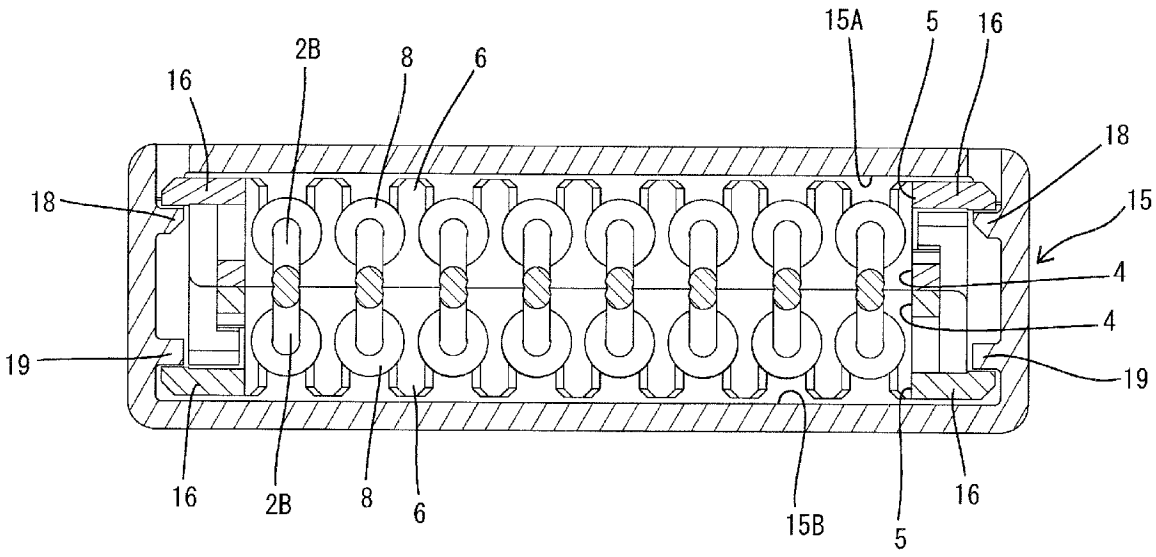
FIG. 22 is a front view in section showing the state of FIG. 20.

As shown in FIG. 16, upper and lower supporting edges 18, 19 protrude inward in the width direction on each of the inner surfaces of opposite widthwise side walls of the casing 15. The respective supporting edges 18, 19 extend along the front-back direction of the casing 15 and are formed over the entire length of the casing 15. As shown in FIGS. 19 and 22, the respective supporting edges 18, 19 sandwich the corresponding protruding pieces 16 of the connector housings 14 in the stacked state together with a ceiling wall 15A or a bottom wall 15B of the casing 15. Thus a sliding movement of the connectors C3 in the stacked state can be guided in the front-back direction in the casing 15.

Front and rear holding projections (not shown) at a distance (distance substantially equal to a width of the protruding piece 16 in the front-back direction) from each other in the front-back direction respectively project toward the ceiling wall 15A of the casing 15 substantially in a central part of one (e.g. upper supporting edge 18) of the upper and lower supporting edges 18, 19 on one side. When the connectors C3 in the stacked state are accommodated partly into the casing 15 from the front and the rear ends of the protruding pieces 16 of the upper connector housing 14 come into contact with the front holding projections, the connectors are stopped at the operation position with respect to the casing 15. When the connectors C3 are pushed strongly into the casing 15 from this position, locking between the protruding pieces 16 and the front holding projections is released. The protruding pieces 16 are sandwiched from front and back by the front and rear holding projections so that the connectors C3 are held at the storage position with respect to the casing 15.

Next, functions of the third embodiment configured as described above are described. The wires 2 are set with respect to the two connector housings 14 and the entire core exposed portions 2B are located in the openings 4 and the operation holes 5. In this state, the connector housings 14 are stacked while the surfaces where the openings 4 face each other. In this way, the connectors C3 are held in the stacked state since the lock pieces 12 and the lock receiving portions cooperate with and are locked into each other at the diagonal positions.

Subsequently, the connectors in the stacked state are fit into the casing 15. Then, as described above, the connectors C3 are stopped temporarily first when the protruding pieces 16 of the upper connector housing 14 come into contact with the front holding projections (not shown). This position is the operation position shown in FIGS. 17 and 18 where the windows 17 of the casing 15 are aligned with the operation holes 5 and the openings 4.

A welding operation is performed at the operation position. Specifically, electrodes 9 of a resistance welding machine are inserted into both connectors through the windows 17 of the casing 15 and the corresponding operation holes 5 and the core exposed portions 2B corresponding in the stacking direction are welded to each other.

After the welding operation is completed in this way, a pushing force is applied to fit the connectors C3 deeper into the casing 15. Since a contact state of the protruding pieces 16 and the front holding projections is released in this way, the connectors C3 can be brought to the storage position. The protruding pieces 16 of the connectors C3 are sandwiched from front and back by the front and rear holding projections at the storage position. Thus, the connectors C3 are stored while being positioned in the front-back direction in the casing 15. Further, at the storage position, the operation holes 5 of the connectors C3 and the windows 17 of the casing 15 are not aligned. As a result, the operation holes 5 are hidden inside the casing 15 and the windows 17 of the casing 15 are closed by front areas of the outer surfaces of the connector housings 14. Thus, foreign matter, such as dust, cannot enter the connectors C3.

The other configuration is the same as in the first embodiment and, hence, can exhibit similar functions and effects. In addition, since the connectors C3 are stored to be surrounded by the casing 15 according to the third embodiment, an effect of preventing the connectors C3 from being inadvertently unlocked from each other is obtained.

The invention is not limited to the above described and illustrated embodiments. For example, the following embodiments are also included in the scope of the invention.

Although the connectors having the same configuration are stacked in each of the above embodiments, connectors having different configurations may be stacked.

Although the welding operation is performed with the connectors stacked in the above embodiments, it is also possible to weld the core exposed portions 2B before the wires 2 are set in the respective connector housings and, thereafter, set the wires 2 in the respective connector housings.

Although the cover 10 is provided with the retainer function for the wires 2 in the first embodiment, it may have only a function of merely opening and closing the operation hole 5 without having the retainer function.

Although the core exposed portions 2B are connected by resistance welding in the above embodiments, they may be connected by another connection method, such as soldering.

In the first embodiment, the cover 10 also may be formed with partition walls 6 to partition between the core exposed portions 2B (in a welded state) adjacent in the width direction when the cover 1 is at the closed position.

Although two connectors are stacked in the above embodiments, three or more connectors may be stacked.

LIST OF REFERENCE SIGNS

1, 14 . . . connector housing
2 . . . wire
2A . . . coating
2B . . . core exposed portion
3A . . . front cavity
3B . . . rear cavity
4 . . . opening
5 . . . operation hole
10 . . . cover
15 . . . casing
17 . . . window
C1 to C3 . . . connector

The invention claimed is:

1. A connector, comprising:

a first synthetic resin housing with opposite front and rear ends spaced apart in a front-rear direction, a first cavity extending through the first housing from the front end to the rear end and a first opening extending through the first housing in a direction transverse to the front-rear direction, the first opening intersecting the first cavity;

a second synthetic resin housing with opposite front and rear ends spaced apart in the front-rear direction, a second cavity extending through the second housing from the front end to the rear end, and a second opening extending through the second housing in a direction transverse to the front-rear direction, the second opening communicating with the first opening of the first housing while facing the first opening of the first housing when the first and second housings are stacked; and first and second wires mounted respectively in the first and second cavities and having core exposed portions by removing a part of a coating from the wires, the core exposed portions being aligned with one another in a stacking direction of the first and second housings, the core exposed portion of at least the first wire being deformed toward the second opening and directly connected with the core exposed portion of the second wire when the first and second housings stacked.

2. The connector of claim 1, wherein:

the first opening includes a first operation hole open on an outer surface of the first housing facing away from the second housing in the stacking direction and exposing the core exposed portion of the first wire to outside; and the second opening includes a second operation hole open on an outer surface of the second housing facing away from the first housing in the stacking direction for exposing the core exposed portion of the second wire to outside.

3. The connector of claim 2, wherein the first and second housings are provided respectively with first and second covers for opening and closing the respective first and second operation holes formed therein.

4. The connector of claim 2, wherein:

the first and second housings are provided with at least one of a lock and a lock receiving portion for locking the first and second housings in a stacked state; and the lock and the lock receiving portion are lockable to each other both in a stacked state where the first and second housings are stacked such that the wires pulled out to outside from the respective housings extend in the same direction and in a stacked state where the housings are stacked such that the wires pulled out to outside from the respective housings extend in opposite directions.

5. The connector of claim 2, further comprising a substantially tubular casing for accommodating the first and second housings in a stacked state, the casing being formed with a pair of windows for exposing the respective operation holes of the housings in a stacked state, wherein:

the housings in the stacked state are slidable between an operation position where the operation holes are aligned with the windows of the casing and a storage position where the windows are closed by outer surfaces of the housings with the operation holes and the windows not aligned.

6. The connector of claim 1, wherein a plurality of wires are accommodated in parallel in the first and second housings and at least one of the housings includes the core exposed portion of the wire intersecting with the other core exposed portions and connected at each intersecting portion.

7. The connector of claim 1, wherein the core exposed portion of the second wire is deformed toward the first opening.

8. The connector of claim 7, wherein the core exposed portions of the first and second wires are connected directly to one another at positions in a plane where the first and second housings are in a stacked face-to-face engagement with one another.

9. The connector of claim 8 wherein the core exposed portions of the first and second wires are welded directly to one another.

* * * * *